US011654597B1

(12) United States Patent
Leserra

(10) Patent No.: US 11,654,597 B1
(45) Date of Patent: May 23, 2023

(54) HANDHELD HYDRAULIC-POWERED CONCRETE-CUTTING HANDSAW

(71) Applicant: Jeff Leserra, Fellsmere, FL (US)

(72) Inventor: Jeff Leserra, Fellsmere, FL (US)

( * ) Notice: Subject to any disclaimer, the term of this patent is extended or adjusted under 35 U.S.C. 154(b) by 208 days.

(21) Appl. No.: 16/847,338

(22) Filed: Apr. 13, 2020

Related U.S. Application Data

(60) Provisional application No. 62/834,510, filed on Apr. 16, 2019.

(51) Int. Cl.
*B28D 1/04* (2006.01)
*B28D 7/00* (2006.01)
*B25F 5/00* (2006.01)

(52) U.S. Cl.
CPC ..... *B28D 7/00* (2013.01); *B25F 5/001* (2013.01); *B25F 5/005* (2013.01); *B28D 1/04* (2013.01); *B28D 1/045* (2013.01)

(58) Field of Classification Search
CPC ... B28D 1/04; B28D 1/045; B25F 5/00; B25F 5/005; B27B 9/00; B27B 5/00; B27B 5/29; Y10T 83/7793
USPC ..... 30/388, 389; 173/218
See application file for complete search history.

(56) References Cited

U.S. PATENT DOCUMENTS 2,884,902 A 5/1959 Headings
2,921,492 A 1/1960 Worth
3,722,496 A 3/1973 Schuman
3,896,783 A 7/1975 Manning
4,236,356 A 12/1980 Ward
4,557,245 A 12/1985 Bieri
4,570,609 A 2/1986 Hogue
4,848,001 A 7/1989 Clark et al.
4,870,946 A 10/1989 Long et al.
5,038,474 A * 8/1991 Larsson ..... B27B 5/14 125/11.22
5,115,796 A 5/1992 Schweickhardt
5,435,294 A 7/1995 Williamson
5,575,271 A 11/1996 Chiuminatta et al.
5,724,956 A 3/1998 Ketterhagen
6,050,253 A 4/2000 Nilsson et al.
6,422,228 B1 7/2002 Latham
(Continued)

OTHER PUBLICATIONS

Wolverine Compact Combo found at https://www.concutusa.comlproduct/wolverinecompact-combo-hydraulic- handsaws/.

*Primary Examiner* — Andrew M Tecco
*Assistant Examiner* — Jacob A Smith
(74) *Attorney, Agent, or Firm* — The Patent Professor, P.A.; John Rizvi

(57) ABSTRACT

A handheld hydraulic-powered concrete-cutting handsaw is provided including a base. A blade guard may be provided on the base. A hydraulic blade motor may be provided on the blade guard. A sawblade may be drivingly engaged for rotation by the blade motor. A front handle and a rear handle may be removably attached to the blade guard and/or base. The handsaw can further include a removable slurry guard. A coolant manifold may be provided on the blade guard. A coolant flow control valve may be confluently connected to the coolant manifold. A coolant supply line may be confluently connected to the coolant flow control valve. A pair of coolant discharge lines may be confluently connected to the coolant manifold and discharge at opposite sides of the sawblade.

15 Claims, 5 Drawing Sheets

(56) References Cited

U.S. PATENT DOCUMENTS

| | | | | |
|---|---|---|---|---|
| 6,442,841 | B1 * | 9/2002 | Nilsson | B23D 59/02 30/389 |
| 6,464,573 | B1 | 10/2002 | Keller | |
| 6,470,874 | B1 | 10/2002 | Mertes | |
| 6,874,400 | B2 | 4/2005 | Johannson | |
| 6,907,874 | B1 | 6/2005 | Faircloth | |
| 7,114,494 | B2 | 10/2006 | Baratta | |
| 7,143,760 | B2 | 12/2006 | Gardner | |
| 7,520,799 | B2 | 4/2009 | Wedel et al. | |
| 7,571,720 | B2 | 8/2009 | Donnerdal et al. | |
| 8,011,357 | B2 | 9/2011 | Johansson | |
| 8,151,783 | B2 | 4/2012 | Baratta | |
| 8,839,778 | B2 | 9/2014 | South | |
| 9,168,596 | B2 | 10/2015 | Jonsson | |
| 9,662,800 | B2 | 5/2017 | Carlsson et al. | |
| 2006/0288992 | A1 | 12/2006 | Baratta | |
| 2007/0163566 | A1 | 7/2007 | Johnson et al. | |
| 2009/0236900 | A1 | 9/2009 | Due et al. | |
| 2010/0018514 | A1 * | 1/2010 | Wills, II | B23D 47/04 30/379.5 |
| 2014/0013909 | A1 * | 1/2014 | Carlsson | B23D 45/16 83/100 |
| 2014/0034349 | A1 * | 2/2014 | Kumar | F01C 13/02 173/221 |
| 2017/0225358 | A1 | 8/2017 | Carlsson et al. | |

* cited by examiner

HANDHELD HYDRAULIC-POWERED CONCRETE-CUTTING HANDSAW

CROSS-REFERENCE TO RELATED APPLICATION

This application claims the benefit of United States Provisional Patent Application No. 62/834,510, filed on Apr. 16, 2019, which is incorporated by reference herein in its entirety.

FIELD OF THE INVENTION

The present invention relates generally to saws, and more particularly, to a handheld hydraulic-powered concrete-cutting handsaw which is easy to handle and operate and suitable for cutting concrete floors, walls, window openings, door openings, subs, wall corners and the like and to flush cut walls from a floor surface.

BACKGROUND OF THE INVENTION

In the construction of concrete structures such as sidewalks, walkways, parking lots and the like, it may be necessary to cut seams, grooves or other cuts in the concrete to form expansion joints or channels or other openings to facilitate insertion of walls or other structures. Concrete saws are commonly used to form cuts in set concrete. A typical concrete saw may include a saw frame on which a trigger-operated motor is mounted. A circular sawblade having multiple cutting teeth in its edge may be drivingly engaged for rotation by the motor. Upon rotation of the sawblade by the motor, the cutting teeth contact and form the cut in the concrete.

One or more handles may be integrally formed with the saw frame to enable an operator to hold and guide the saw during the cutting operation. A slurry guard may also be integrally formed with the saw frame to receive slurry from the concrete in operations in which the saw is used to cut freshly-poured concrete. The handles and slurry guard are often damaged during use of the handsaw.

Concrete saws frequently utilize sawblades having diamond-impregnated cutting teeth. The cutting teeth may be attached to the sawblade using soldering or an adhesive material, During the cutting operation, the sawblade and blade hub may become heated to the point at which the solder joint or adhesive breaks, causing the cutting teeth to break from the sawblade. Moreover, stress fractures may form in the sawblade itself, potentially compromising its cutting efficiency. Thus, concrete saws may include a water-cooling system to cool the sawblade during operation of the saw.

Hand-operated saws provide several advantages over other types of sawblades. For example, hand-operated saws which utilize a circular sawblade may be capable of making deeper cuts than saws which are not hand-operated. Moreover, hand-operated saws typically offer an ergonomic advantage over saws which are not hand-operated. Thus, hand-operated saws may be easier to balance, handle, guide or manipulate than other types of saws.

One of the drawbacks of conventional concrete saws is that the handles and slurry guard on the saw frame may not be positioned for optimal balancing and ergonomic operation of the saw. Additionally, the handles may not be optimally positioned to enable an operator to easily pull the trigger to operate the sawblade motor.

Accordingly, there is an established need for a handheld hydraulic-powered concrete-cutting handsaw to handle and operate and suitable for cutting concrete floors, walls, window openings, door openings, subs, wall corners and the like and to flush cut walls from the floor surface, wherein the handsaw solves at least one of the aforementioned problems. For example, there remains a need for a handheld hydraulic-powered concrete-cutting handsaw which is easy to maintain or repair in the event of failure or damage of one or more of its components.

SUMMARY OF THE INVENTION

The present invention is directed to a handheld hydraulic-powered concrete-cutting handsaw which is easy to handle and operate and suitable for cutting concrete floors, walls, window openings, door openings, subs, wall corners and the like and to flush cut walls from the floor surface. The concrete-cutting handsaw may include a base. A blade guard may be provided on the base. A hydraulic blade motor may be mounted on the blade guard. A sawblade may be drivingly engaged for rotation by the blade motor. A hydraulic control valve having a valve plunger assembly may be confluently connected to the blade motor through a motor-actuating line. A hydraulic fluid supply line and a hydraulic fluid return line may be confluently connected to the hydraulic control valve and the blade motor, respectively. A bypass line may connect the hydraulic control valve to the hydraulic fluid return line. A rear handle may be removably mounted on the blade guard. A speed control valve trigger may be pivotally mounted on the rear handle. The speed control valve trigger may have a speed control trigger bearing which actuates the valve plunger assembly of the hydraulic control valve. A front handle may be removably mounted on the blade guard and/or the base. The rear handle and the front handle may be suitably placed and configured to optimize user comfort in pulling the speed control valve trigger on the hydraulic control valve. A coolant flow control valve may be confluently connected to a coolant supply line and a coolant manifold. A pair of coolant discharge lines may be confluently connected to the coolant manifold. The coolant flow control valve, the coolant supply line, the coolant manifold and the coolant discharge lines may be positioned at the upper portion of the blade guard to optimize the positions of these components and eliminate or minimize interference with operation of the handsaw. The hydraulic control valve may adjustably divide distribution of the hydraulic fluid between the motor-actuating line and the bypass line to vary the operational speed of the blade motor responsive to depression or manipulation of the speed control valve trigger.

In a first implementation of the invention, a handheld hydraulic-powered concrete-cutting handsaw comprises a base, a blade guard carried by the base, a hydraulic blade motor arranged above the base, and a sawblade drivingly engaged for rotation by the blade motor. A top portion of the sawblade is covered by the blade guard and a bottom portion of the sawblade protrudes downwardly form the blade guard and the base. The handsaw further includes a rear handle arranged above the base, and a front handle arranged forward of the blade motor and above the base. A hydraulic control valve is arranged above the base. The hydraulic control valve includes a valve plunger assembly having a valve plunger, and is configured to regulate a flow of hydraulic fluid to the blade motor responsively to movement of the valve plunger. The handsaw further includes a speed control valve trigger comprising a first trigger portion and a second trigger portion. The first trigger portion is arranged adjacent to the rear handle and is configured to enable manual operation of the first trigger portion by a hand grasping the rear handle. In turn, the second trigger portion is configured to adjustably compress the valve plunger responsively to manual operation of the first trigger portion.

In a second aspect, the second trigger portion may be configured to adjustably push against a free end of the valve plunger responsively to manual operation of the first trigger portion.

In another aspect, the second trigger portion may include a rotatable bearing configured to push against and roll on the free end of the valve plunger.

In another aspect, the valve plunger assembly may include a compression spring biasing the valve plunger to an extended position.

In yet another aspect, the compression spring may be configured to exert an expansion force on a free end of the valve plunger, and the second trigger portion may be configured to adjustably push against the free end of the valve plunger.

In another aspect, the speed control valve trigger may be rotatable relative to the rear handle about a trigger rotation axis responsively to a torque caused by manual operation of the first trigger portion.

In another aspect, the trigger rotation axis may be located adjacent and slightly offset of the valve plunger.

In another aspect, the second trigger portion may be configured to adjustably push against a top end of the valve plunger. The trigger rotation axis may be located above and slightly offset of a central longitudinal axis of the valve plunger.

In yet another aspect, the first trigger portion may be elongate in shape and arranged in a spaced-apart, generally parallel relationship with the rear handle.

In another aspect, the first trigger portion may be arranged below the rear handle.

In another aspect, the handsaw may further include a coolant manifold carried by the blade guard, a coolant flow control valve in fluid communication with the coolant manifold, a coolant supply line in fluid communication with the coolant flow control valve, and two coolant discharge lines in fluid communication with the coolant manifold and configured to discharge coolant fluid at opposite sides of the sawblade. The coolant flow control valve, the coolant manifold and the coolant discharge lines may be positioned at the upper portion of the blade guard.

In yet another aspect, the handsaw may further include a hydraulic fluid supply line configured to supply hydraulic fluid to the hydraulic control valve, a motor-actuating line providing hydraulic fluid communication between the hydraulic control valve and the blade motor, a hydraulic fluid return line configured to discharge hydraulic fluid from the blade motor, and a bypass line providing hydraulic fluid communication between the hydraulic control valve to the hydraulic fluid return line. The hydraulic control valve may be configured to adjustably divide distribution of hydraulic fluid between the motor-actuating line and the bypass line to vary an operational speed of the blade motor responsive to manual operation of the first trigger portion of the speed control valve trigger.

In another aspect, the handsaw may further include a slurry guard detachably attached to the base behind the blade motor.

In another aspect, the slurry guard may be attached to and extend rearward from a rear end of the base.

In another aspect, the rear a may be removably carried by the blade guard.

In another aspect, the rear handle, hydraulic control valve and speed control valve trigger may be attached to one another forming a rear handle unit that is removably secured to the blade guard.

In another aspect, the rear handle unit may be selectively and removably securable in more than one position relative to the blade guard with a relative positioning of the rear handle, hydraulic control valve and speed control valve trigger remaining constant.

In yet another aspect, the front handle may be removably carried by the blade guard and/or the base.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements; and in which.

Like reference numerals refer to like parts throughout the several views of the drawings.

DETAILED DESCRIPTION

Figure 1:
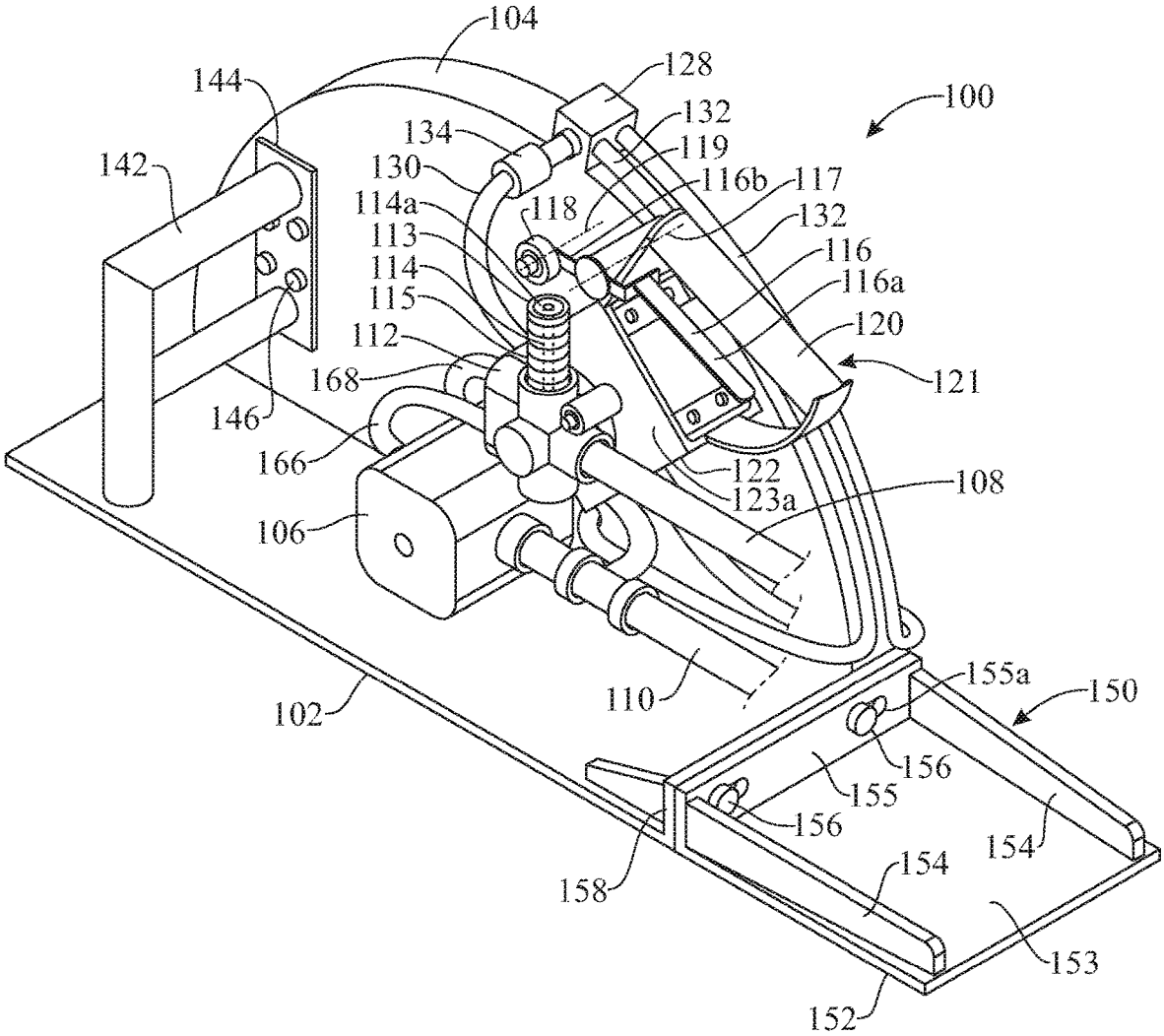
FIG. 1 presents a top rear perspective view showing a handheld hydraulic-powered concrete-cutting handsaw in accordance with an illustrative embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a handheld hydraulic-powered concrete-cutting handsaw which is easy to handle and operate and suitable for cutting concrete floors, walls, window openings, door openings, subs, wall corners and the like and to flush cut walls from the floor surface.

Referring initially to FIGS. 1-4, an illustrative embodiment of the handheld hydraulic-powered concrete-cutting handsaw, hereinafter handsaw, is generally indicated by reference numeral 100. The handsaw 100 may include a base 102. In some embodiments, the base 102 may be elongated and rectangular, as illustrated. A blade guard 104 may be provided on the base 102, extending upward from the base 102, as shown. The blade guard 104 may be elongated and semicircular and may extend along a longitudinal side edge of the base 102, perpendicularly upward from the base 102.

The handsaw 100 further includes a blade motor 106, which may be mounted on the blade guard 104 according to the knowledge of those skilled in the art. The blade motor 106 is hydraulic. A hydraulic control valve 112 may be disposed in fluid communication with an inlet of the blade motor 106 through a motor-actuating line 166. At least one hydraulic fluid supply line 108 may be disposed in fluid communication with the hydraulic control valve 112. A hydraulic fluid pump and supply mechanism (not illustrated) may be disposed in fluid communication with the hydraulic fluid supply line 108, as is known by those skilled in the art. A hydraulic fluid return line 110 may be disposed in fluid communication with an outlet of the blade motor 106. The hydraulic fluid pump and supply mechanism may be disposed in fluid communication with the hydraulic fluid return line 110. A bypass line 168 may confluently connect the hydraulic control valve 112 to the hydraulic fluid return line 110. Accordingly, operation of the blade motor 106 may take place responsively to operation of the hydraulic fluid pump and supply mechanism as hydraulic fluid (not illustrated) typically flows through the hydraulic fluid supply line 108, the hydraulic control valve 112, the motor-actuating line 166, the blade motor 106 and the hydraulic fluid return line 110, respectively, and back to the hydraulic pump and supply mechanism.

The hydraulic control valve 112 may have a valve plunger assembly 113. The valve plunger assembly 113 can include a valve plunger 114 which may be deployable at different positions in the hydraulic control valve 112 to open the hydraulic control valve 112 to various degrees and facilitate corresponding flow rates or volumes of the hydraulic fluid through the hydraulic control valve 112 to the motor-actuating line 166 and the bypass line 168. A speed control valve trigger 116 is operable by a user to vary the speed of the handsaw 100. More specifically, depending on the position of the speed control valve trigger 116, the hydraulic control valve 112 may adjustably apportion or distribute the hydraulic fluid supplied via the hydraulic fluid supply line 108 between the motor-actuating line 166 and the bypass line 168 to operate the blade motor 106 at a corresponding adjustable speed. In some embodiments, the hydraulic control valve 112 may include a hydraulic pressure relief valve (not illustrated) to prevent excessive pressure of the hydraulic fluid flowing to the blade motor 106 which may otherwise cause damage to and/or failure of the blade motor 106. A compression spring 115 can operably engage the valve plunger 114 to bias the valve plunger 114 to an extended or non-compressed state in which the valve plunger 114 does not activate the hydraulic control valve 112 and thus hydraulic fluid flow from the hydraulic fluid supply line 108 to the motor-actuating line 166 is prevented, and the fluid is instead diverted to the bypass line 168. In the present embodiment, for instance and without limitation, the compression spring 115 is arranged radially, outward and surrounding the valve plunger 114 and is configured to bias or push the valve plunger 114 outward (e.g., vertically upward) of the hydraulic control valve 112.

Figure 3:
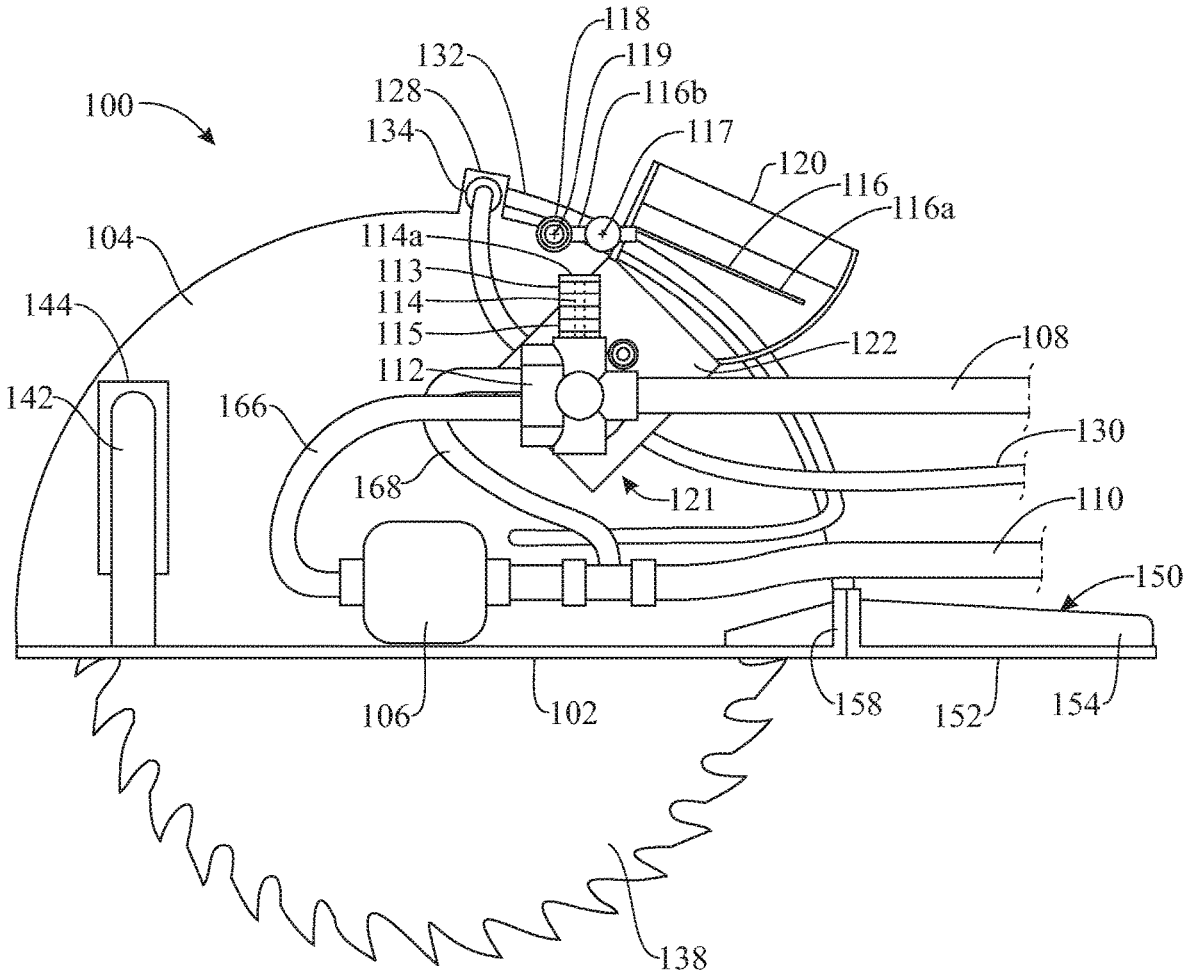
FIG. 3 presents a left side elevation view of the handheld hydraulic-powered concrete-cutting handsaw of FIG. 1.
Figure 4:
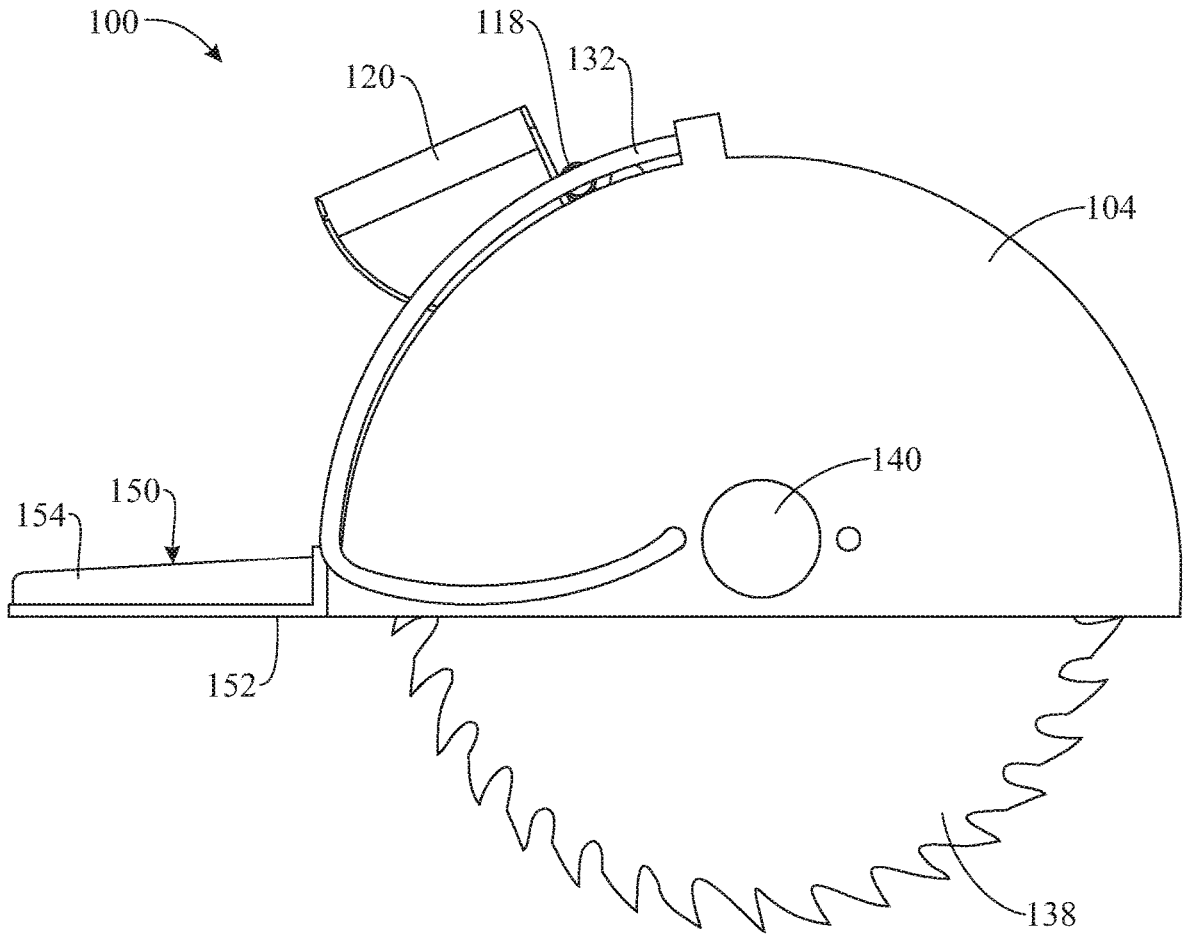
FIG. 4 presents a right side elevation view of the handheld hydraulic-powered concrete-cutting handsaw of FIG. 1.

As illustrated in FIGS. 3 and 4, a sawblade 138 may be drivingly engaged for rotation by the blade motor 106. In some embodiments, sawblade 138 may be a circular diamond-segmented sawblade known by those skilled in the art for the purpose of cutting concrete. As illustrated in FIG. 4, a blade hub 140 may mount the sawblade 138 on the blade motor 106. In some embodiments, the blade hub 140 may be made of stainless steel.

Figure 2:
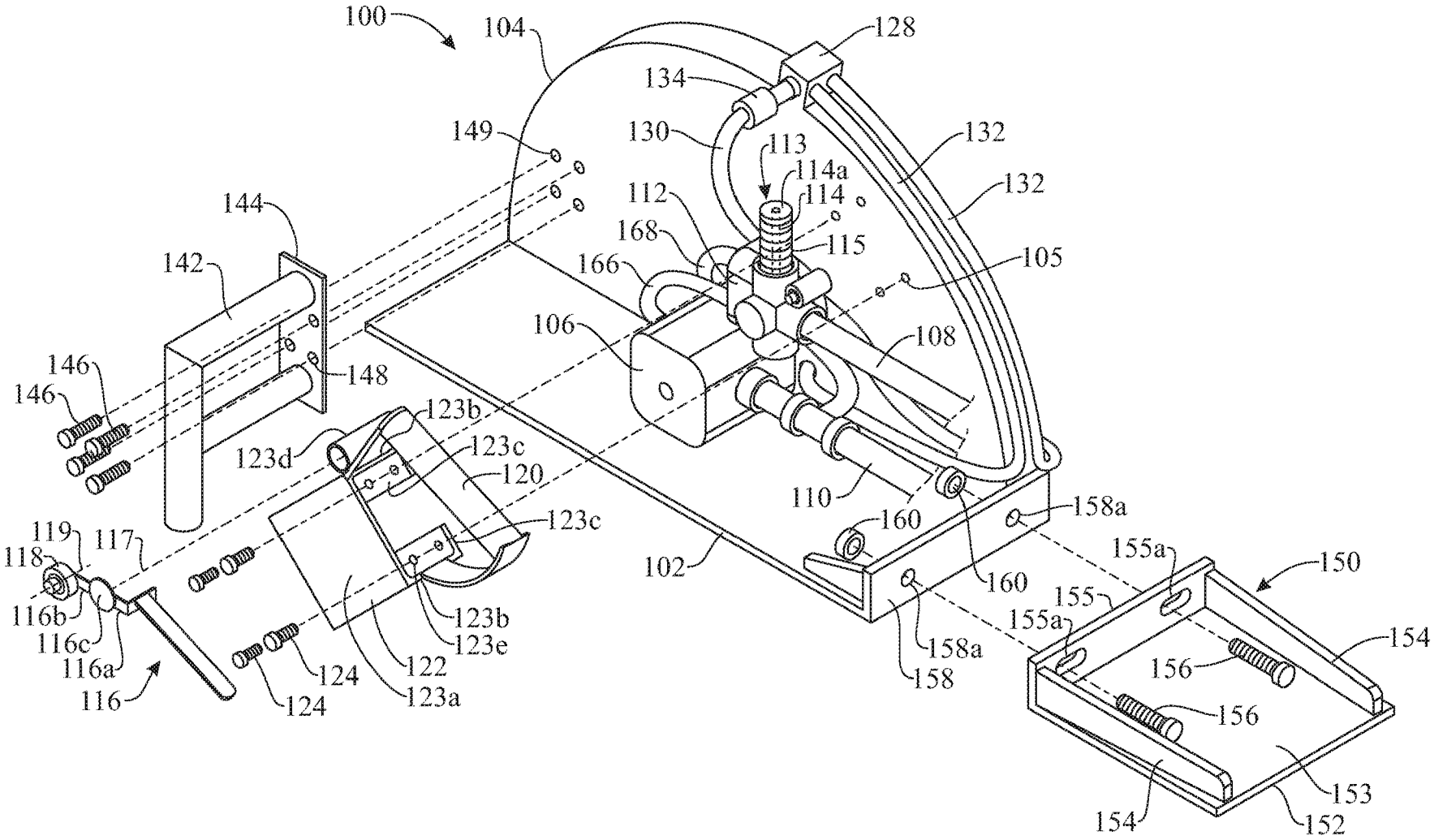
FIG. 2 presents an exploded top rear perspective view of the handheld hydraulic-powered concrete-cutting handsaw of FIG. 1.

As illustrated in FIGS. 1 and 2, a first or rear handle 120 may be removably mounted on the blade guard 104. In some embodiments, a rear handle mount bracket 122 may mount the rear handle 120 on the blade guard 104. For instance, in the present embodiment, as best shown in FIG. 2, the rear handle mount bracket 122 includes a generally C-shaped body formed by a first, generally flat outer plate 123*a*, two transverse, parallel and spaced-apart connecting plates 123*b* extending from opposite front and rear edges of the outer plate 123*a*, and two opposing end plates 123*c* extending towards one another from the connecting plates 123*b*. The end plates 123*c* may be coplanar and configured to rest on a flat outer surface of the blade guard 104, as shown. A trigger connector 123*d* may be attached to the front L-shaped arm 123*b* for purposes that will be hereinafter described. As shown, bracket mount bolts 124 may be extended through respective bolt openings 123*e* in the end plates 123*c* of the rear handle mount bracket 122 and threaded or extended through corresponding registering bolt openings 105 in the blade guard 104. Securing nuts (not illustrated) may be threaded on the respective bracket mount bolts 124 and tightened in order to secure the end plates 123*c*, and thus the rear handle mount bracket 122, against the blade guard 104.

In some embodiments, such as the present embodiment, the hydraulic control valve 112 is carried by the rear handle 120, such as by having the hydraulic control valve 112 attached or mounted to the rear handle mount bracket 122, as best shown in FIG. 1, More specifically, in the present embodiment, the outer plate 123*a* serves as a mounting area for the hydraulic control valve 112; for instance and without limitation, the hydraulic control valve 112 may be adhered, welded or otherwise attached to the outer plate 123*a*. As best shown in FIG. 3, the rear handle 120 may be positioned above and to the rear of the hydraulic control valve 112. Alternatively or additionally, the speed control valve trigger 116 may be carried by or affixed to the rear handle 120. For example, in the present embodiment, the speed control valve trigger 116 is mounted to the trigger connector 123*d*, which is in turn attached to the rear handle mount bracket 122, such as by welding or other well-known methods of attaching or integrally-forming metallic or plastic parts. In some embodiments, the rear handle 120 may be selectively mounted in different positions within the handsaw 100, i.e. relative to the base 102 and blade guard 104. For instance, the blade guard 104 may include additional bolt openings 105 to the ones depicted herein, to allow a user to select to which subset of bolt openings 105 the rear handle 120 is attached. Alternatively or additionally, the bolt openings 123*e* and/or bolt openings 105 may be formed as elongated holes or slots which allow sliding and repositioning of the rear handle 120 relative to the blade guard 104 prior to tightening the bracket mount bolts 124 and corresponding nuts. In particularly advantageous embodiments, such as the present embodiment, the rear handle 120 carries both the hydraulic control valve 112 and the speed control valve trigger 116 (e.g., via the rear handle mount bracket 122) such that the rear handle 120, hydraulic control valve 112 and speed control valve trigger 116 form a rear handle assembly 121 or unit that is jointly repositionable to different positions along the blade guard 104. In being a unit, the relative positioning of all three elements (rear handle 120, hydraulic control valve 112 and speed control valve trigger 116) is maintained, regardless of where on the blade guard 104 the rear handle assembly 121 is specifically and selectively attached. Such repositioning is further facilitated by having the fluid lines described herein that are connected to the hydraulic control valve 112 (i.e. hydraulic fluid supply line 108, motor-actuating line 166 and bypass line 168) formed of one or more flexible materials, or otherwise flexible.

As described heretofore, the hydraulic control valve 112 may control the flow of hydraulic fluid through the blade motor 106 by adjustably diving the fluid fed through the fluid supply line 108 into a first flow directed to the blade motor 106 via the motor-actuating line 166 and a second flow directed to the hydraulic fluid return line 110 via the bypass line 168. As further illustrated in FIGS. 1 and 2, in order to facilitate convenient user-operation of the hydraulic control valve 112, the speed control valve trigger 116 may be pivotally mounted on the rear handle mount bracket 122, and preferably below the rear handle 120, as shown, such as generally or approximately parallel to and spaced apart from the rear handle 120. The speed control valve trigger 116 is rotatable about a trigger rotation axis 117, located above the hydraulic control valve 112, as best shown in FIG. 3. As best shown in FIG. 2, the speed control valve trigger 116 may include a first trigger portion 116*a* and a second trigger portion 116*b* extending from opposite sides of an intermediate portion 116*c*, wherein the portions 116*a*, 116*b* and 116*c* may form a single-piece unit or a unit that is jointly rotatable about the trigger rotation axis 117. More specifically, the intermediate portion 116*c* may be rotatably connected to the trigger connector 123*d* of the rear handle mount bracket 122, such as by a shaft (not shown), thereby defining the trigger rotation axis 117.

A speed control trigger bearing 118 can be rotatably attached to or carried by the second trigger portion 116*b* and can be configured to rotate relative to the second trigger portion 116*b* about a bearing rotation axis 119 which can be parallel to the trigger rotation axis 117. The speed control valve trigger 116 may operably engage the valve plunger assembly 113 to open and close the hydraulic control valve 112 responsive to actuation of the speed control valve trigger 116; more specifically, in the present embodiment, the speed control trigger bearing 118 is configured to roll upon and axially push on an outer end of the valve plunger assembly 113 (e.g., a smooth top spring-retaining end 114*a* of the valve plunger assembly 113) when the user operates the first trigger portion 116*a* and the first and second trigger portions 116*a*, 116*b* consequently rotate jointly about the trigger rotation axis 117, said axial pushing of the speed control trigger bearing 118 causing the valve plunger 114 to advance into the hydraulic control valve 112 (enabling/increasing hydraulic fluid flow) and the compression spring 115 to compress. Accordingly, finger actuation of the speed control valve trigger 116 facilitates variable positioning of the valve plunger assembly 113 in the hydraulic control valve 112 and corresponding variable flow rates of the hydraulic fluid through the hydraulic control valve 112 to the blade motor 106, and hence, variable rotational speeds of the sawblade 138. As best shown in FIG. 2, the first trigger portion 116*a* being arranged beneath, spaced-apart from, and generally parallel to the rear handle 120 facilitates the user grasping the rear handle 120 from above and operating the first trigger portion 116*a* by pulling upward on the first trigger portion 116*a* with one or more fingers. Upward pulling of the first trigger portion 116*a* towards the rear handle 120 causes a downward rotation of the second trigger portion 116*b* and speed control trigger bearing 118 towards, and adjustably onto, the valve plunger 114, to operate the hydraulic control valve 112. Having the trigger rotation axis 117 above the valve plunger 114, and in near vertical alignment (i.e. only slightly offset) with a central vertical axis of the valve plunger 114, as shown, allows to minimize the size of the second trigger portion 116*b*, contributing to reduce the overall weight and increase compactness of the handsaw 100. The rear handle 120 and first trigger portion 116*a* being in turn positioned generally immediately rearward of the trigger rotation axis 117 further contributes to minimize size and weight of the speed control valve trigger 116 and thus of the handsaw 100.

At least one coolant discharge line 132 may be positioned adjacent to at least one of the side surfaces of the sawblade 138. In some embodiments, such as the present embodiment, a pair of coolant discharge lines 132 may be positioned adjacent to the respective opposite side surfaces of the sawblade 138, as illustrated. A coolant manifold 128 may be mounted on the blade guard 104 at a fixed position, as shown, or adjustable positions. The coolant manifold 128 may be disposed in fluid communication with a coolant fluid pump and supply mechanism (not illustrated) through a coolant supply line 130. A coolant flow control valve 134 may be provided in the coolant supply line 130. The coolant discharge lines 132 may be disposed in fluid communication with the coolant manifold 128. The coolant discharge lines 132 may extend initially along the upper surface of the blade guard 104 and then through respective openings (not illustrated) in the opposite sides of the blade guard 104, discharging adjacent to the respective side surfaces of the sawblade 138. In operation of the handsaw 100, responsive to operation of the coolant fluid pump and supply mechanism, coolant fluid (not illustrated) may flow through the coolant supply line 130, the coolant flow control valve 134, and the coolant manifold 128, and then through the respective coolant discharge lines 132, and may be discharged from the respective coolant discharge lines 132 against the respective side surfaces of the sawblade 138 to cool the sawblade 138.

In some embodiments, the coolant manifold 128, coolant supply line 130, coolant discharge lines 132 and coolant flow control valve 134 may be positioned at the upper portion of the blade guard 104, as illustrated, to optimize the positions of these components and eliminate or minimize interference during operation of the handsaw 100.

As shown in FIG. 1, a second or front handle 142 may be removably mounted on at least one of the base 102 and the blade guard 104 in front of the blade motor 106. As illustrated in FIGS. 1 and 2, in some embodiments, a front handle mount bracket 144 may mount the front handle 142 to the blade guard 104. As illustrated in FIG. 2, multiple bracket mount bolts 146 may be extended through respective bolt openings 148 in the front handle mount bracket 144 and extended or threaded through corresponding registering bolt openings 149 in the blade guard 104. Securing nuts (not illustrated) may be threaded on the respective bracket mount bolts 146 and tightened against the blade guard 104. Accordingly, the rear handle 120 and the front handle 142 may enable an operator (not illustrated) to easily guide and manipulate the handsaw 100 during cutting operations. In some embodiments, the front handle 142 may be selectively mounted in different positions within the handsaw 100, i.e. relative to the base 102 and blade guard 104. For instance, the blade guard 104 may include additional bolt openings 149 to the ones depicted herein, to allow a user to select to which subset of bolt openings 149 the front handle 142 is attached. Alternatively or additionally, the bolt openings 148 and/or bolt openings 149 may be formed as elongated holes or slots which allow sliding and repositioning of the front handle 142 relative to the blade guard 104 prior to tightening the bracket mount bolts 146 and corresponding nuts.

With continued reference to FIG. 1, a slurry guard 150 may be provided on the base 102, typically on a rear end of the handsaw 100 behind the blade motor 106 and longitudinally opposite to the front handle 142. In some embodiments, the slurry guard 150 may be removably mounted on the base 102 to allow for rapid and convenient disassembly of the slurry guard 150 when required such as for maintenance or replacement purposes. The slurry guard 150 may include a slurry guard bracket 152. The slurry guard bracket 152 may have a bottom, slurry guard protecting wall 153, which may be planar (as shown) or present alternative shapes, a pair of elongated, parallel, spaced-apart slurry guard sidewalls 154 extending upward from the slurry guard protecting wall 153, and a transverse mounting wall 155 extending between the slurry guard sidewalls 154 and the slurry guard protecting wall 153 at a front end of the slurry guard bracket 152. A slurry guard mount flange 158 may be provided on the base 102. As illustrated in FIGS. 1 and 2, a pair of slurry guard mount bolts 156 may be extended through registering pairs of bolt openings 155*a*, 158*a* in the transverse mounting wall 155 of the slurry guard bracket 152 and the slurry guard mount flange 158, respectively, and securing nuts 160 threaded on the respective slurry guard mount bolts 156 to detachably mount the slurry guard 150 on the base 102. In some embodiments, one or both of the bolt openings 155*a* and 158*a* may be transversely elongated or slot-shaped to allow for relative transverse adjustment between the slurry guard 150 and the base 102; for instance, in the present embodiment, as best shown in FIG. 2, the bolt openings 155*a* of the transverse mounting wall 155 of the slurry guard bracket 152 are elongated or slot-shaped while the bolt openings 158*a* in the slurry guard mount flange 158 are round.

Figure 5:
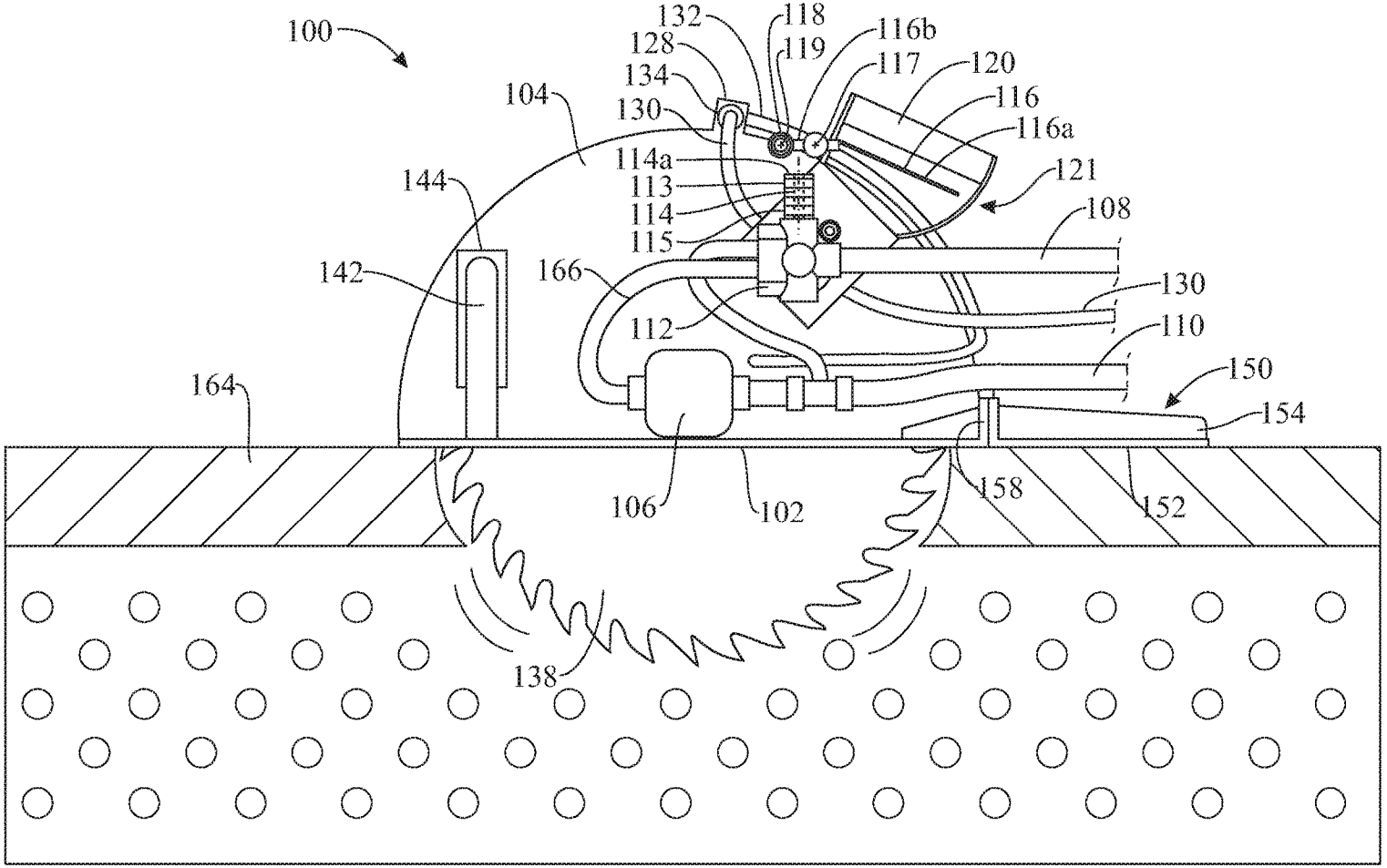
FIG. 5 presents a left side elevation view of the handheld hydraulic-powered concrete-cutting handsaw of FIG. 1, cutting a workpiece in typical operation of the handsaw.

Referring next to FIG. 5, in typical application, the handsaw 100 may be operated to cut a concrete workpiece 164 in the construction of concrete structures such as such as sidewalks, walkways, parking lots and the like. Accordingly, the hydraulic fluid pump and supply mechanism (not illustrated) may be connected to the hydraulic fluid supply line 108 and the hydraulic fluid return line 110. The coolant fluid pump and supply mechanism (not illustrated) may be connected to the coolant manifold 128 through the coolant supply line 130.

An operator (not illustrated) of the handsaw 100 may grip the rear handle 120 with a rear hand and the front handle 142 with the other, front hand. As he or she actuates the speed control valve trigger 116 with a finger on the rear hand, hydraulic fluid may flow from the hydraulic fluid pump and supply mechanism (not illustrated) through the hydraulic fluid supply line 108, hydraulic control valve 112, motor-actuating line 166, bypass line 168, blade motor 106, hydraulic fluid return line 110 and back to the hydraulic fluid pump and supply mechanism. Accordingly, the blade motor 106 may rotate the sawblade 138 as the sawblade 138 cuts the workpiece 164. The operator may vary the operational speed of the blade motor 106 and rotational speed of the sawblade 138 by correspondingly varying the position of the speed control valve trigger 116 using his or her finger(s) as the speed control valve trigger 116 varies the position of the valve plunger assembly 113 in the hydraulic control valve 112 and the hydraulic control valve 112 apportions or distributes the hydraulic fluid between the motor-actuating line 166 and the bypass line 168. It will be appreciated by those skilled in the art that, due to the smooth top spring retainer (not numbered), the speed control trigger bearing 118 may roll smoothly and easily along the valve plunger assembly 113. This expedient may impart ease in pulling the speed control valve trigger 116 and smooth progression in control ling the operational speed of the blade motor 106.

As it rotates in the blade guard 104 and cuts the workpiece 164, the sawblade 138 may heat considerably due to friction. Accordingly, the coolant fluid pump and supply mechanism (not illustrated) may pump coolant fluid through the coolant supply line 130, the coolant flow control valve 134, the coolant manifold 128 and the coolant discharge lines 132, respectively, and discharged against the respective side surfaces of the sawblade 138 to cool the sawblade 138. It will be appreciated by those skilled in the art that the coolant manifold 128, coolant supply line 130, coolant discharge lines 132 and coolant flow control valve 134 may be positioned at the upper portion of the blade guard 104, as illustrated, to eliminate or minimize interference with operation of the handsaw 100 and to more effectively manage the supply of coolant fluid for the sawblade 138.

During operation of the handsaw 100, the slurry guard 150 may engage and be dragged along the concrete workpiece 164 to function as a heel and steady the handsaw 100 during operation. In the event that it becomes damaged or wears out, the slurry guard 150 may be replaced typically by removing the slurry guard mount bolts 156, removing the worn slurry guard 150 from the base 102 and fastening a replacement slurry guard 150 to the base 102 typically using the slurry guard mount bolts 156.

It will be appreciated by those skilled in the art that the rear handle 120 and/or the front handle 142 may be selectively and individually replaced, as necessary, in the case of excessive wearing or damage without having to replace the entire handsaw 100. Accordingly, the rear handle 120 may be replaced typically by unthreading the bracket mount bolts 124 (FIG. 2) from the rear handle mount bracket 122, disengaging the rear handle mount bracket 122 with the old rear handle 120 from the blade motor 106, and fastening the rear handle mount bracket 122 of a replacement rear handle 120 to the blade motor 106 typically using the bracket mount bolts 124. The front handle 142 may be replaced typically by unthreading the bracket mount bolts 146 from the front handle mount bracket 144, disengaging the front handle mount bracket 144 of the old front handle 142 from the blade guard 104, and fastening the front handle mount bracket 144 of a replacement front handle 142 to the blade guard 104 typically using the bracket mount bolts 146.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A handheld hydraulic-powered concrete-cutting handsaw, comprising:

a generally flat and horizontal base;

a blade guard carried by and extending upward from and generally perpendicularly to the base;

a hydraulic blade motor arranged above the base;

a sawblade drivingly engaged for rotation by the blade motor, a top portion of the sawblade covered by the blade guard and a bottom portion of the sawblade protruding downwardly from the blade guard and the base;

a rear handle arranged above the base, and above and rearward of the blade motor;

a front handle arranged above the base, and forward of the blade motor and the rear handle;

a hydraulic control valve arranged above the base, the hydraulic control valve comprising a valve plunger assembly including a compressible and expandable valve plunger, the hydraulic control valve configured to regulate a flow of hydraulic fluid to the blade motor responsively to an adjustable compression of the valve plunger; and a speed control valve trigger comprising a first trigger portion and a second trigger portion jointly rotatable relative to the rear handle about a trigger rotation axis, wherein the first trigger portion is arranged adjacent to and below the rear handle and configured to enable a manual upward rotation of the first trigger portion about the trigger rotation axis by a hand grasping the rear handle, and the second trigger portion is configured to rotate downward about the trigger rotation axis and adjustably push against a free end of the valve plunger and thereby adjustably compress the valve plunger responsively to said manual upward rotation of the first trigger portion.

2. The handsaw of claim 1, wherein the second trigger portion comprises a rotatable bearing configured to push against and roll on the free end of the valve plunger.

3. The handsaw of claim 1, wherein the valve plunger assembly comprises a compression spring biasing the valve plunger to an extended position.

4. The handsaw of claim 3, wherein the compression spring is configured to exert an expansion force on a free end of the valve plunger, and further wherein the second trigger portion is configured to adjustably push against the free end of the valve plunger.

5. The handsaw of claim 1, wherein the trigger rotation axis is located adjacent and slightly offset of the valve plunger.

6. The handsaw of claim 5, wherein the second trigger portion is configured to adjustably push against a top end of the valve plunger, and further wherein the trigger rotation axis is located above and slightly offset of a central longitudinal axis of the valve plunger.

7. The handsaw of claim 1, wherein the first trigger portion is elongate in shape and arranged in a spaced-apart, generally parallel relationship with the rear handle.

8. The handsaw of claim 1, further comprising a coolant manifold carried by the blade guard, a coolant flow control valve in fluid communication with the coolant manifold, a coolant supply line in fluid communication with the coolant flow control valve, and two coolant discharge lines in fluid communication with the coolant manifold and configured to discharge coolant fluid at opposite sides of the sawblade, wherein the coolant flow control valve, the coolant manifold and the coolant discharge lines are positioned at the upper portion of the blade guard.

9. The handsaw of claim 1, further comprising a hydraulic fluid supply line configured to supply hydraulic fluid to the hydraulic control valve, a motor-actuating line providing hydraulic fluid communication between the hydraulic control valve and the blade motor, a hydraulic fluid return line configured to discharge hydraulic fluid from the blade motor, and a bypass line providing hydraulic fluid communication between the hydraulic control valve to the hydraulic fluid return line, wherein the hydraulic control valve is configured to adjustably divide distribution of hydraulic fluid between the motor-actuating line and the bypass line to vary an operational speed of the blade motor responsive to said manual upward rotation of the first trigger portion of the speed control valve trigger.

10. The handsaw of claim 1, further comprising a slurry guard detachably attached to the base behind the blade motor.

11. The handsaw of claim 10, wherein the slurry guard is attached to and extends rearward from a rear end of the base.

12. The handsaw of claim 1, wherein the rear handle is removably carried by the blade guard.

13. The handsaw of claim 12, wherein the rear handle, hydraulic control valve and speed control valve trigger are attached to one another forming a rear handle unit that is removably secured to the blade guard.

14. The handsaw of claim 13, wherein the rear handle unit is selectively and removably securable in more than one position relative to the blade guard with a relative positioning of the rear handle, hydraulic control valve and speed control valve trigger remaining constant.

15. The handsaw of claim 1, wherein the front handle is removably carried by the blade guard and/or the base.

* * * * *